United States Patent [19]

Carpenter

[11] 4,027,492

[45] June 7, 1977

[54] TRANSPORTABLE BOAT LIFT

[75] Inventor: Charles R. Carpenter, Jamestown, N.Y.

[73] Assignee: Metallic Ladder Manufacturing Corporation, Randolph, N.Y.

[22] Filed: June 10, 1976

[21] Appl. No.: 694,557

[52] U.S. Cl. ..... 61/65; 114/45; 214/1 A

[51] Int. Cl.[2] ..... B63C 1/02

[58] Field of Search ..... 61/65, 97, 67; 114/45; 214/1 A

[56] References Cited

UNITED STATES PATENTS

| | | | |
|---|---|---|---|
| 2,612,025 | 9/1952 | Hunsucker | 61/97 |
| 3,077,742 | 2/1963 | Brown | 61/65 |
| 3,216,704 | 11/1965 | Smith | 214/1 A X |
| 3,265,024 | 8/1966 | Kramlich | 61/65 X |
| 3,753,355 | 8/1973 | Knoch | 61/65 |

*Primary Examiner*—Jacob Shapiro
*Attorney, Agent, or Firm*—Bean, Kauffman & Bean

[57] ABSTRACT

A transportable boat lift including a framework having a base portion and a boat support portion mounted on the base portion for vertically directed movement between extended or boat supporting and non-supporting or retracted positions, and at least one flotation device coupled to the framework for effecting submersion/emersion thereof incident to such movements of the boat support portion relative to the base portion.

9 Claims, 11 Drawing Figures

Fig. 6.
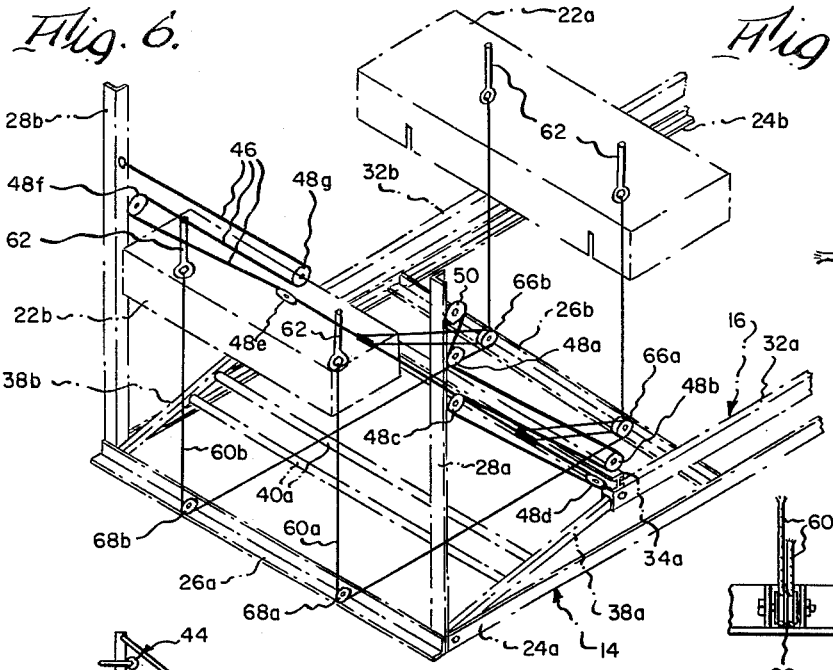
Fig. 5.
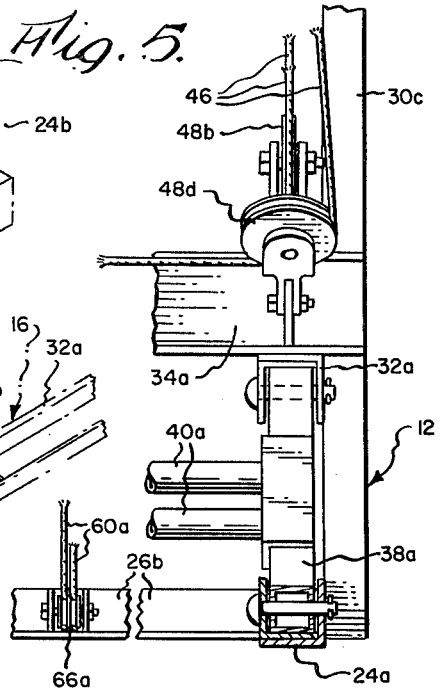
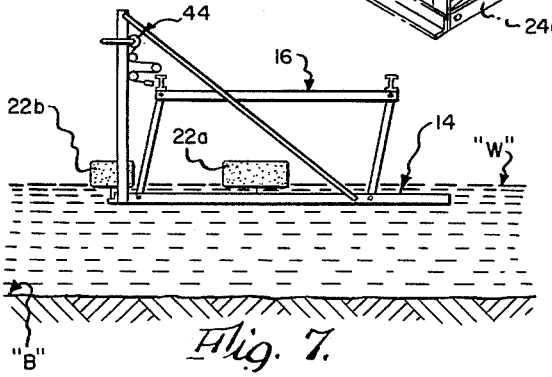
Fig. 7.
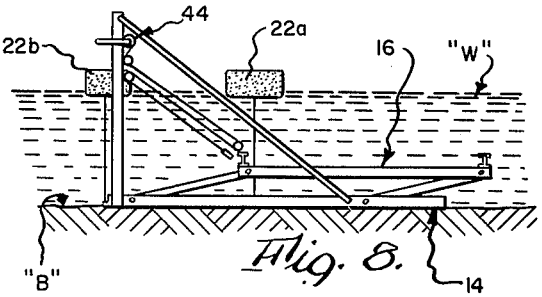
Fig. 8.
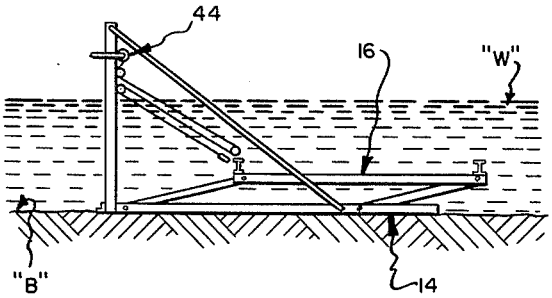
Fig. 9.
Fig. 10.
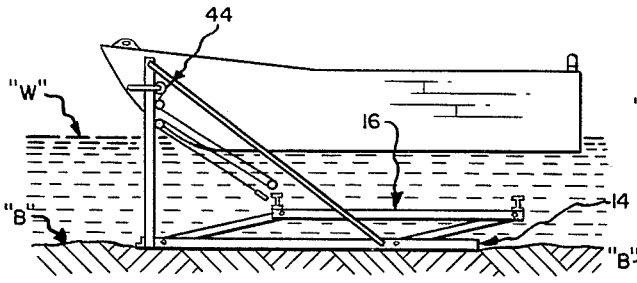
Fig. 11.
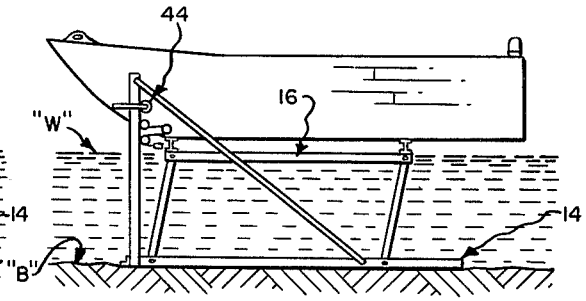

TRANSPORTABLE BOAT LIFT

BACKGROUND OF THE INVENTION

There are presently available boat lifts of the type adapted to be removably placed in shallow bodies of water, such as lakes and rivers in order to provide "docking" facilities for small boats during the summer months. These lifts normally include a framework having a base portion adapted to be bottom supported within a body of water and a boat support portion adapted to be moved vertically relative to the base portion for selectively lifting a boat above the surface of the water and lowering same into a floating condition. A major drawback of prior small boat lifts of this type is the difficulty encountered in transporting same to a desired anchorage and/or returning same to dry land for winter storage.

Further, flotation devices of various types have previously been employed to support dry docks for transport to a desired location and/or to selectively effect raising and lowering of a boat, as evidenced for instance by U.S. Pat. No. 1,296,662 and Re. Pat. No. 27,090. However, to the best of my knowledge, flotation devices have not been successfully associated with small boat lifts or comparative devices in order to both facilitate transportation thereof to and from an offshore anchorage and assist in effecting submersion/emersion thereof at such anchorage.

SUMMARY OF THE INVENTION

The present invention is directed towards transportable boat lifts and more particularly towards a flotation system operable to provide a bouyant support for a boat lift during transport thereof to and from a desired anchorage, and to control submersion/emersion of such boat lift at the point of anchorage.

In a preferred form of the invention, the boat lift includes a framework having a base portion adapted to be bottom supported within a body of water and a boat support portion mounted on the base portion for vertical movement relative thereto between a boat supporting position and a non-supporting position; an operator controlled cable system for effecting movements of the boat support portion relative to the base portion; at least one flotation device; and a cable system for connecting the flotation device to the framework, such that the framework may be lowered and raised within the body of water incident to vertical movements of the boat support portion relative to the base portion.

DRAWINGS

The nature and mode of operation of the present invention will now be more clearly described in the following detailed description taken with the accompanying drawings wherein:

FIG. 5 is a sectional view taken generally along the lines 5—5 in FIG. 2;

FIG. 6 is a perspective view illustrating cable systems employed in the lift; and FIGS. 7 through 11, inclusive, are schematic views illustrating the mode of operation of the present lift.

DETAILED DESCRIPTION

Figure 1:
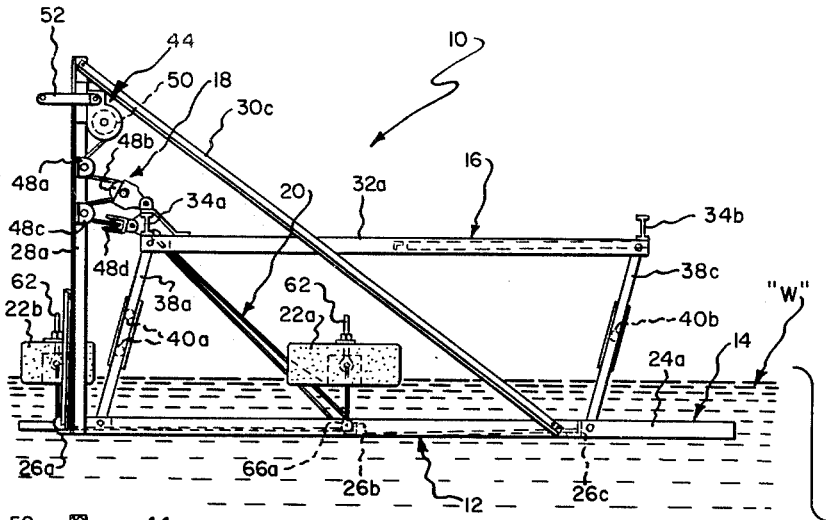
FIG. 1 is a side elevational view of a transportable boat lift formed in accordance with the present invention and showing the lift in a "floating" or transport condition.

A boat lift formed in accordance with the present invention is generally designated as 10 in the drawings. More particularly, lift 10 is shown in FIGS. 1–6 as including a metal framework 12 having a base portion 14 and a boat support portion 16; an operator controlled or first cable system 18, which serves to control movements of boat support portion 16 between its extended or boat supporting and retracted or non-supporting positions shown for instance in FIGS. 11 and 10, respectively; and a second cable system 20, which serves to attach or couple flotation devices **22*a* and 22*b* to framework 12**.

Now making reference particularly to FIGS. 1–5, it will be understood that base portion 14 includes an anchor portion, which is defined by a pair of parallel side rails **24*a* and 24*b*, which are rigidly interconnected by means of a plurality of parallel, transversely extending members 26*a*, 26*b* and 26*c* and suitably braced by a pair of members 26*d*; and a standard, which is fixed to upstand from adjacent one end of the anchor portion and is defined by a pair of parallel posts 28*a* and 28*b*. Posts 28*a* and 28*b* may be suitably braced as by means of members 30*a*–30*d***.

Boat support portion 16 is shown in FIGS. 1–5 as comprising a pair of parallel side rails **32*a* and 32*b*, which are rigidly interconnected by a pair of transversely extending, boat supporting "I" beams 34*a* and 34*b* and a transversely extending rigidifying beam 34*c* arranged intermediate "I" beams 34*a* and 34*b*, and which are suitably braced by a pair of members 34*d***.

By again referring to FIGS. 1–5, it will be understood that boat support portion 16 is mounted on the anchor portion of base frame portion 14 by means of a plurality of pivotally end connected, parallel links **38*a*–38*d*, which serve to maintain the support and anchor portions in essentially parallel relationship, during converging/diverging movements of the support portion between its remote or boat supporting position, shown for instance in FIGS. 1 and 11, and its adjacent or non-supporting position, shown for instance in FIGS. 2 and 10. Preferably, adjacent pairs of links 38*a*, 38*b* and 38*c*, 38*d* are braced or interconnected by tubes 40*a* and 40*b***, respectively.

Cable system 18 includes a manually operable cable takeup device 44, which is fixed to standard **28*a*, and a flexible cable 46, which has its opposite ends fixed to takeup device 44 and standard 28*b* and successively trained about pulleys 48*a*–48*g* intermediate such ends. It will be understood that pulleys 48*a* and 48*c* are fixed to standard 28*a*; pulleys 48*b*, 48*d*, 48*e* and 48*g* are fixed to "I" beam 34*a*; and pulley 48*f* is fixed to standard 28*b*. Takeup device 44 would normally include a takeup drum 50 on which cable 46 is adapted to be wound as a result of operator induced rotations of a handle 52, and a releasable ratchet type brake device, not shown, which serves to releasably constrain cable unwinding rotations of drum 50. As will be apparent, when handle 52 is operated to effect winding of cable 46 on to drum 50, boat support portion 16 is caused to move vertically relative to base portion 14 between the adjacent and remotely disposed positions shown in FIGS. 2 and 1, respectively, whereas the effect of gravity is relied upon to bias boat support portion 16 for return movement into its initial position when the ratchet device is released and cable 46 unwound from drum 50. Alternately, cable system 18 may be modified in order to positively drive boat support portion 16 for both diverging and converging movements relative to base portion 14. As thus far described, lift 10** is similar to prior lift constructions.

Second cable system 20 preferably includes a pair of cables 60*a* and 60*b*, which have their opposite ends releasably attached or coupled to float devices 22*a* and 22*b*, such as by threaded bolt devices 62, and are fixed intermediate such ends to "I" beam 34*a*, as by suitable clamp devices 64*a* and 64*b*, so as to divide cables 60*a* and 60*b* into first and second cable runs. The portions of cables 60*a* and 60*b* forming a first of such runs are opposite end connected to float device 22*a* and "I" beam 34*a* and trained about double pulleys 66*a* and 66*b*, which are fixed to member 26*b*. The portions of cables 60*a* and 60*b* forming a second of such runs are opposite end connected to float device 22*b* and "I" beam 34*a* and trained successively about pulleys 68*a* and 68*b*, which are fixed to member 26*b*, and double pulleys 66*a* and 66*b*. As will be apparent, this mode of interconnecting float devices 22*a* and 22*b* with framework 12 effects divergent and convergent movements of the float devices and base portion 14 incident to convergent and divergent movements of boat support portion 16 and the base portion, respectively.

Figure 2:
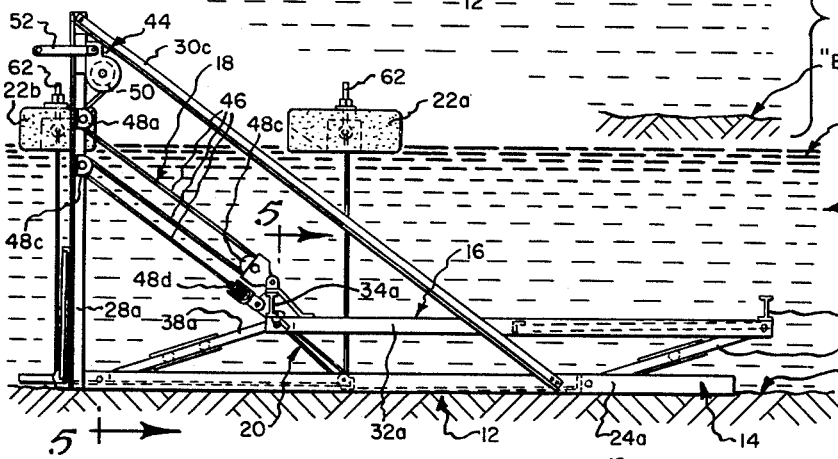
FIG. 2 is a view similar to FIG. 1, but showing the lift in an installed or submerged condition.
Figure 3:
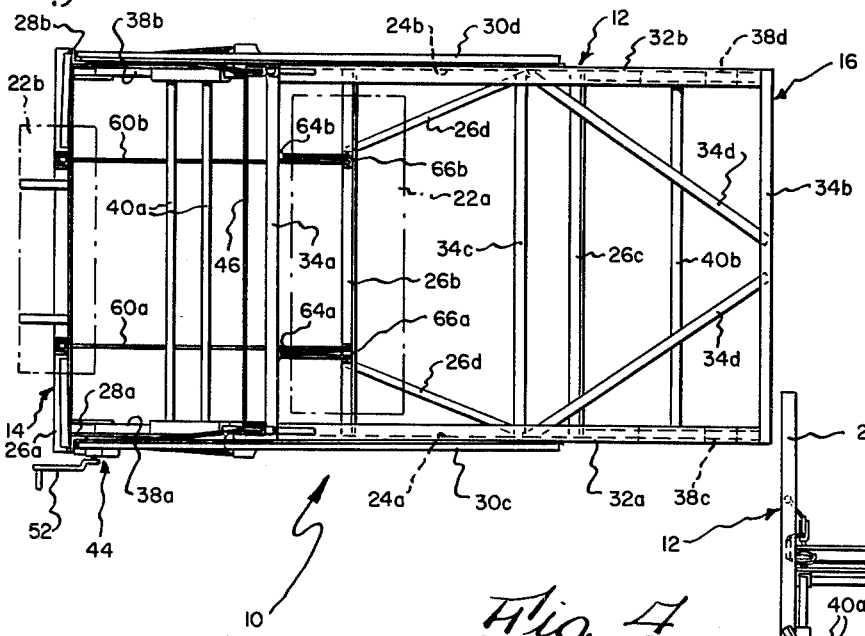
FIG. 3 is a top plan view of a lift, as viewed in FIG. 2.
Figure 4:
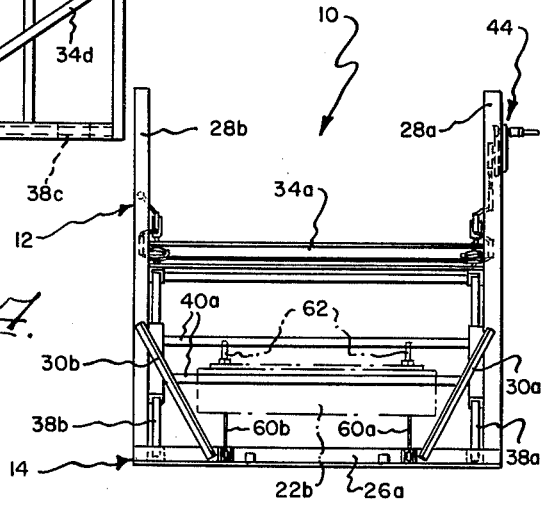
FIG. 4 is a left hand elevational view of the lift, as viewed in FIG. 1.

In the preferred form of the present invention, float devices 22*a* and 22*b* are of a constant or permanent buoyancy construction, such as would be defined by a block of foamed plastic material, and made selectively operable for the purpose of lowering/raising framework 12 within a body of water "W" by the simple expedient of providing suitable attachment devices permitting attachment/removal of the float devices from cables 60*a* and 60*b*, while the framework is in its submerged condition shown for instance in FIGS. 2 and 8. This is desirable, since it provides for a relatively inexpensive construction and permits safe on-shore storage of the float devices, except for short periods of time during which they are employed to transport or raise/lower the framework. When the float devices are removed, the free ends of cables 60*a* and 60*b* may be suitably tied or clamped to the framework in order to facilitate location thereof, when it is desired to reattach the float devices at the end of a boating season. Alternatively, cables 60*a* and 60*b* could be elongated and provided with plural attachment points for the float devices, such as to enable the float devices to remain permanently attached to the cables while permitting the cables to be selectively placed in a slack or float inoperative condition after the float device has been submerged at a point of intended anchorage. Also, it is anticipated that float devices of a suitable variable buoyancy construction, such as would include inflatable/deflatable balloon type floats or expulsion tank type floats may be employed in the practice of the present invention in those cases where it is found desirable to permanently associate float devices with framework 14.

Operation of boat lift 10 will now be described with particular reference to FIGS. 7–11. Thus, FIG. 7 shows the lift in its initial transport or floating condition, wherein boat support portion 16 is extended and float devices 22*a* and 22*b* are retracted relative to base portion 14. After boat lift 10 has been manually positioned in a desired location or anchorage, takeup device 44 may be operated to permit gravity induced lowering of base portion 14 into engagement with bottom "B" of body of water "W", as indicated in FIG. 8, incident to movement of boat support portion 16 between its extended position and its retracted position. Hereafter, float devices 22*a* and 22*b* could be removed for summer storage purposes and the lift permitted to reside in its normal rest or inoperative condition illustrated in FIG. 9.

Subsequently, when it is desired to "dock" a boat, that boat would be first positioned in vertical alignment with boat support portion 16, as indicated in FIG. 10, and takeup device 44 would then be operated to move boat support portion 16 into its extended position to effect lifting of such boat above the surface of the water to a temporary storage condition, as indicated in FIG. 11. The boat may be subsequently lowered into a floating condition by operation of the takeup device to return boat support portion 16 to its retracted position shown in FIG. 10.

At the completion of the boating season, boat lift 10 may be raised and transported to a suitable on-shore storage area, by first attaching float devices 22*a* and 22*b* to the submerged lift, as indicated in FIG. 8, and then employing the takeup device to raise the lift into its transport condition shown in FIG. 7 incident to movement of the boat support portion into its extended position.

I claim:

1. A transportable boat lift comprising in combination:

a framework including a base portion for supporting said framework by bottom engagement within a body of water and a boat support portion mounted on said base portion for vertical movement relative thereto between boat supporting and non-supporting positions;

operator control means for controlling movement of said boat support portion between said positions;

flotation means; and means for movably attaching said flotation means to said base and boat support portions for lowering and raising said framework to removably position said base portion for bottom engagement within said body of water incident to vertical movements of said boat support portion between said positions.

2. A transportable boat lift according to claim 1, wherein said base portion includes an anchor portion adapted to be disposed for bottom engagement within said body of water and a standard vertically sized to upstand above the surface of said body of water in which said boat lift is intended to be anchored when said anchor portion is in bottom engagement, said boat support portion is mounted on said anchor portion by a plurality of parallel links having opposite ends thereof connected to said boat support portion and said anchor portion whereby to maintain said boat support portion in an essentially parallel relationship with said anchor portion during movement of said boat support portion between said positions, said operator control means includes an operator controlled cable system interconnecting said standard and said boat support portion, and said means for attaching said flotation means to said base and boat support portions includes cable devices trained about said anchor portion for opposite end connection with said flotation means and said boat support portion, whereby said flotation means is caused to move relatively towards said anchor portion incident to movement of said boat support portion relatively away from said anchor portion.

3. A transportable boat lift according to claim 1, wherein said means for attaching said flotation means to said base and boat support portions includes cable devices trained about said base portion for opposite end connection with said flotation means and said boat support portion, whereby said flotation means is caused to move relatively towards said base portion incident to movement of said boat support portion relatively away from said base portion.

4. A transportable boat lift according to claim 3, wherein said flotation means is removably connected to said cable devices.

5. A transportable boat lift comprising in combination:

a parallelogram linkage system defined by an anchor portion intended to be removably bottom supported within a body of water, a boat support portion arranged parallel to said anchor portion and intended when said anchor portion is bottom supported for removable underengagement with a boat to effect lifting thereof into a storage position disposed above the surface of said body of water and to return same to floating condition upon diverging and converging movements of said boat support portion relative to said anchor portion, respectively, and parallel links having opposite ends thereof pivotally joined to said anchor portion and said boat support portion for movably interconnecting said boat support portion to said anchor portion;

a standard connected to said anchor portion and sized to vertically upstand above the surface of said body of water when said anchor portion is bottom supported;

operator controlled means for controlling diverging and converging movements of said boat support portion relative to said anchor portion, said operator controlled means including a manual operator mounted on said standard for positioning above the surface of said body of water when said anchor portion is bottom supported and cable means interconnecting said operator and said boat support portion;

flotation means; and means for connecting said flotation means to said boat support portion for effecting submersion/emersion of said boat lift incident to movements of said boat support portion relative to said anchor portion.

6. A transportable boat lift according to claim 5, wherein said means for connecting said flotation means includes cable means connected to said boat support portion and trained about said anchor portion for connection to said flotation means, whereby to cause converging movement of said flotation means and said anchor portion incident to diverging movement of said boat support portion and said anchor portion.

7. A transportable boat lift according to claim 6, wherein said flotation means is removably connected to the last said cable means.

8. A transportable boat lift comprising in combination:

a framework having a base portion for supporting said framework by bottom engagement within a body of water and a boat support portion mounted on said base portion for vertically directed movements relative thereto between extended/boat supporting and retracted/non-supporting positions;

means for controlling movements of said boat support position between said positions;

flotation means; and means for movably coupling said flotation means to said base and boat support positions for selectively effecting submersion of said framework to position said base portion for bottom engagement incident to movement of said boat support portion from said extended/boat supporting position into said retracted/non-supporting position and emersion of said framework for removing said base portion from bottom engagement incident to movement of said boat portion from said retracted/non-supporting position into said extended/boat supporting position.

9. A transportable boat lift according to claim 8, wherein said flotation means includes at least one permanent buoyancy float device, and said means for coupling said flotation means to said base and boat support portions includes cable devices trained about said base portion for opposite end connection with said float device and said boat support portion, and said cable devices being releasably attached to said float device.

* * * * *